US010267553B2

(12) United States Patent
Malisi et al.

(10) Patent No.: US 10,267,553 B2
(45) Date of Patent: Apr. 23, 2019

(54) HOUSEHOLD REFRIGERATOR WITH AN ICEMAKER UNIT AND A COOLING DEVICE HAVING A PRESSURE CHAMBER FOR COOLING THE ICEMAKER UNIT

(71) Applicant: BSH HAUSGERAETE GMBH, Munich (DE)

(72) Inventors: Michaela Malisi, Heidenheim (DE); Ulrich Kriegsmann, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 79 days.

(21) Appl. No.: 15/622,339

(22) Filed: Jun. 14, 2017

(65) Prior Publication Data

US 2017/0363339 A1 Dec. 21, 2017

(30) Foreign Application Priority Data

Jun. 15, 2016 (DE) ..... 10 2016 210 706

(51) Int. Cl.
*F25D 21/08* (2006.01)
*F25D 17/06* (2006.01)
*F25C 5/20* (2018.01)

(52) U.S. Cl.
CPC ..... *F25D 21/08* (2013.01); *F25C 5/22* (2018.01); *F25D 17/062* (2013.01); *F25D 17/067* (2013.01)

(58) Field of Classification Search
CPC ..... F25D 21/08; F25D 17/062; F25D 17/067; F25C 5/22
See application file for complete search history.

(56) References Cited

U.S. PATENT DOCUMENTS 6,101,835 A * 8/2000 Butsch ..... B67D 1/0864 222/146.1
9,234,690 B2 1/2016 McCollough et al.

FOREIGN PATENT DOCUMENTS

DE 102010041952 A1 4/2012
WO 2013116453 A2 8/2013

* cited by examiner

*Primary Examiner* — Melvin Jones
(74) *Attorney, Agent, or Firm* — Laurence A. Greenberg; Werner H. Stemer; Ralph E. Locher

(57) ABSTRACT

A household refrigerator has a housing formed with a receiving space. An icemaker unit for dispensing ice is arranged in the receiving space. The icemaker unit has a tray in which shaping regions are formed for specifying a shape of shaped ice elements that are produced from liquid poured into the tray. The icemaker unit has a cooling device with which a cooling air flow is produced for cooling the tray. The cooling device has an evaporator and a fan. A fan wheel of the fan blows the cold produced by the evaporator in a cooling air flow. The fan wheel is arranged in a separate pressure chamber.

20 Claims, 5 Drawing Sheets

HOUSEHOLD REFRIGERATOR WITH AN ICEMAKER UNIT AND A COOLING DEVICE HAVING A PRESSURE CHAMBER FOR COOLING THE ICEMAKER UNIT

CROSS-REFERENCE TO RELATED APPLICATION

This application claims the priority, under 35 U.S.C. § 119, of German patent application DE 10 2016 210 706.2, filed Jun. 15, 2016; the prior application is herewith incorporated by reference in its entirety.

BACKGROUND OF THE INVENTION

Field of the Invention

The invention relates to a household refrigerator having a housing, which has a receiving space. Furthermore, the household refrigerator comprises an icemaker unit for dispensing ice, wherein the icemaker unit is located at least in certain regions in the receiving space or is arranged therein at least in certain regions. The icemaker unit has at least one tray in which shaping regions are formed. The shaping regions are formed for specifying the shape of shaped ice elements that can be produced from liquid poured into the tray. The icemaker unit comprises, moreover, a cooling device with which a cooling air flow can be generated for cooling the tray. This cooling device has an evaporator and a fan. The cold or cooling energy produced by the evaporator and which is released into the surroundings of the evaporator or is produced there, can be generated by the fan as a cooling air flow.

A household refrigerator having a unit for dispensing ice cubes is known from international published patent application WO 2013/116453 A2 and its counterpart U.S. Pat. No. 9,234,690 B2. That household refrigerator also comprises, moreover, an evaporator and a fan, by which a cooling air flow can be produced which flows around a tray of a unit in which ice cubes can be produced. This cooling air flow is therefore produced there in a relatively non-directional manner by the fan that is completely exposed in the direction of the tray. Undesirable complete air flow around the tray is also brought about as a result. This also leads to air flowing around the tray at its upper side and consequently part of the water that has been poured in is evaporated before it can freeze into ice. Smaller ice cubes form as a result and these also have very different shapes. A further fundamental drawback with the known embodiment can be seen in that, due to the complete exposure of the fan in the direction of the tray, not only does a non-directional cooling air flow occur, but the pressure of the cooling air flow is also significantly reduced owing to the very large cross-section of the fan wheel in the direction of the tray. An air-volume flow is consequently reduced at specific points of the tray, whereby the freezing rate of the liquid in the tray is then in turn also reduced.

So-called no-frost household refrigerators are also known, for example from commonly assigned German published patent application DE 10 2010 041 952 A1.

SUMMARY OF THE INVENTION

It is accordingly an object of the invention to provide a refrigeration device which overcomes the above-mentioned and other disadvantages of the heretofore-known devices and methods of this general type and which provides for a household refrigerator in which the efficiency of a cooling device of the above-noted kind is improved.

With the foregoing and other objects in view there is provided, in accordance with the invention, a household refrigerator, comprising:

a housing formed with a receiving space;

an icemaker unit disposed in the receiving space for dispensing ice, the icemaker unit including a tray formed with shaping regions for specifying a shape of shaped ice elements to be produced from liquid poured into the tray and a cooling device for producing a cooling air flow for cooling the tray;

the cooling device including an evaporator and a fan with a fan wheel configured to generate the cooling air flow with cold produced by the evaporator; and the cooling device including a separate pressure chamber housing the fan wheel.

In other words, the novel household refrigerator according to the invention has a housing which has a receiving space. The receiving space is designed to receive further components of the household refrigerator. The household refrigerator, which is designed for storing and preserving comestibles, such as food and drink, also comprises an icemaker unit. The icemaker unit is designed, in particular, for dispensing ice. Shaped ice elements, such as ice cubes, can be provided as ice here. However, slush ice can also be dispensed. This icemaker unit has at least one tray in which shaping regions are formed. These shaping regions are formed for specifying the shape of shaped ice elements that can be produced from liquid poured into the tray. The icemaker unit itself comprises a cooling device with which a cooling air flow can be produced for cooling the tray and which flows in the direction of the tray. The cooling device comprises an evaporator and a fan having a fan wheel with which the cold produced by the evaporator can be generated as a cooling air flow. A fundamental idea of the invention can be seen in that the fan wheel is arranged in a separate pressure chamber of this cooling air device. This kind of embodiment of the unit in the form of the cooling air device, which has the evaporator and the fan in a separate module, allows an air-volume flow for the cooling air flow to be increased and also allows the air flow to be conducted in a directed manner towards the tray. Due to the pressure chamber, the air-volume flow is not blown, in particular on the outlet side of the fan, over the entire cross-sectional area of this outlet side. Instead, this pressure chamber forms a volume by which a build-up of the pressure of this cooling air flow, which is improved to a certain extent, is generated owing to the movement of the fan wheel. A pressure chamber in the context of the present invention therefore constitutes a concrete component which enables the cooling air flow produced in the direction of the tray to be produced with an increased air-volume flow. In particular, due to this pressure chamber, an increased pressure of the cooling air flow produced by a fan wheel can be produced before exiting from the pressure chamber in the direction of the tray. An embodiment of this kind also has the further advantage that more effective cooling of the tray is achieved, so, in particular, shaped ice elements can be produced more quickly in the tray from the liquid that has been poured in.

It is precisely due to the embodiment having the pressure chamber that a significantly higher air-volume flow of the cooling air flow is possible even with a simultaneously high counter pressure. It is precisely a high air-volume flow in this regard that also forms an advantageous requirement for achieving fast freezing of the liquid in the tray.

In particular, the household refrigerator has at least one interior space into which the comestibles can be introduced. In particular, the receiving space is designed, at least in certain regions, to receive the icemaker unit in this interior space. The icemaker unit is therefore also preferably arranged, at least in certain regions, in the interior space. A drinks bottle can also be introduced into the icemaker unit in addition to or instead of the tray, so it is then also possible here for this drinks bottle to be cooled by the cooling air flow, which then flows, in particular, in a manner directed toward the drinks bottle.

The cooling device is advantageously designed as a no-frost unit. With this embodiment, cooling is advantageously achieved with the cooling air flow and frosting of the evaporator is reduced.

In accordance with an added feature of the invention, the pressure chamber has a chamber wall which is arranged between the fan, in particular between the fan wheel, and the tray. The chamber wall has an opening through which the cooling air flow can be conducted in a targeted manner to the tray. In the context in respect of its surface area in the plane of the chamber wall, the opening is smaller, in particular much smaller, than the area of the chamber wall itself is. An embodiment of this kind therefore means that more or less a kind of partial covering of the fan or fan wheel is also formed on the side facing the tray. An embodiment of this kind therefore means the maximum area of the fan wheel, over which a cooling air flow is then produced in the direction of the tray in the state of the art, is significantly reduced. In addition to this targeted embodiment and the accompanying improvement in the targeted conduction of cooling air, the pressure generation of the cooling air flow in the pressure chamber is also achieved or improved thereby. It is precisely as a result of this specific position and embodiment of the chamber wall that in this context the cross-section, over which the cooling air flow passes in the direction of the tray, is reduced. In addition to the cooling air flow conduction which is locally more targeted and more limited and which has already been discussed, the air-volume flow is also increased thereby. Furthermore, the occurrence of eddying of the cooling air flow is also reduced by an embodiment of this kind.

In accordance with an additional feature of the invention, the opening in the chamber wall is arranged such that the cooling air flow can be conducted to flow in a targeted manner only under a base of the tray. This is a particularly advantageous design since the cooling air flow is therefore prevented from also flowing over the upper side of the tray, which is remote from the base, to a largely undesirable extent. The additional evaporation of liquid, as is the case due to the cooling air flow flowing over the upper side of the tray and therefore also over the surface of the liquid in the tray, is prevented thereby. This prevents the desired size of the ice cubes from not being attained. In particular, it is provided that overflowing of the cooling air flow over the upper side of the tray is completely prevented.

Furthermore, compared to the prior art designs, this embodiment significantly reduces the probability of, in turn, an undesirable sublimation of these shaped ice elements when the cooling air flow continues to flow against the tray, even when these shaped ice elements have attained the frozen state. The evaporation of the liquid in the tray can also be at least significantly reduced thereby, provided the liquid is not yet solid, is not yet frozen therefore.

With an air flow which only flows under the tray which has a large width and low height, the concept of the pressure chamber is advantageous since a blow-out opening can be formed and this is supplied with the same pressure over its entire cross-sectional area.

In accordance with a further feature of the invention, when viewed in the height direction of the icemaker unit, the opening in this chamber wall is arranged under the tray and above the evaporator. As a result, the height level of this opening is formed in a very targeted, locally limited location which particularly advantageously enables the cooling air flow to be conducted in a locally limited and targeted manner to the tray, in particular to be conducted in a targeted manner only under the base of the tray. The cooling air flow then flows against the tray only at the base. The opening can also be positioned in some other way, however, but in particular the air flow can also then be conducted in particular only under the tray.

It is preferably provided that a flow conduit, or flow channel, protruding from the chamber wall in the direction of the tray is arranged at the opening. This embodiment improves the targeted conduction of the cooling air flow even more. In particular, the targeted flow cooling air against the tray can be improved only in the base thereof. Furthermore, the flow cross-section of the cooling air flow, as then occurs in relation to the overall area of the chamber wall, can be reduced even more. The increase in the air-volume flow is improved even more thereby. In particular, it can be provided that the flow conduit is designed in the form of a nozzle.

It is precisely by way of the embodiment having a flow conduit that pressure losses in the cooling air flow can be significantly reduced, in particular since less eddying occurs in the cooling air flow.

In accordance with a further advantageous embodiment the flow conduit has a beak-like design. This means, in particular also, that the flow conduit, starting from the opening in the chamber wall through to its outlet region remote from this opening, in particular its blow-out opening in this regard, tapers in the manner of a funnel. The regionally targeted and local blowing-out of the cooling air flow is also improved thereby and precisely the flow against the base of the tray is improved; in particular it is achieved that the cooling air flow flows against only the base of the tray.

In accordance with another feature of the invention, the flow conduit ends under a base of the tray. The advantages mentioned above are improved even more thereby.

In accordance with again an added feature of the invention, the chamber wall has a cup-shaped region, so a pressroom or a pressure volume limited by chamber walls of the pressure chamber has a pressure volume region adjoining the cup-shaped region radially in relation to a longitudinal axis of the cup-shaped region and which is designed as a pressure volume ring. This embodiment of the chamber wall arranged between the fan and the tray promotes a particularly advantageous pressure build-up in the pressure chamber. A desirable, increased volume flow can be particularly advantageously achieved thereby.

In particular, it is provided that, in the direction of the longitudinal axis of the cup-shaped region, the fan wheel is arranged adjacent to a base of the cup-shaped region. The position in relation to the pressure volume ring is consequently advantageous and the pressure build-up improved, and this, in turn, has an advantageous effect on the air-volume flow.

It is preferably provided that a radial dimension of the fan wheel is smaller than or equal to a radial dimension of the base of the cup-shaped region. The pressure volume ring is consequently practically produced so as to radially directly adjoin the fan wheel and then also extends, in particular, even further forwards in the axial direction of the cup-shaped region in the direction of the tray than the fan wheel extends in this regard. This results in a correspondingly locally advantageous position and also a geometrically advantageous embodiment of the pressure volume ring. A particularly advantageous pressure build-up is consequently achieved in the pressure chamber.

It is preferably provided that, viewed in the radial direction, the flow conduit is formed on a wall region of the chamber wall that outwardly follows the cup-shaped region in the radial direction. The cooling air flow can consequently very advantageously issue from this pressure chamber volume ring into the flow conduit. Short distances and low eddying of the cooling air flow are consequently achieved. In particular, it is provided that the flow conduit is arranged in an axial extension of the pressure volume ring.

In particular it is provided that the evaporator of the cooling device is arranged in a housing of the cooling device, which is provided with a thermally insulating material at least in certain regions. This is a further very advantageous embodiment because it is precisely when the evaporator is defrosted that undesirable heating of the interior space of the icemaker unit, in which, in particular, the tray is arranged, can be avoided. Undesirable heat input, in particular which would delay freezing of the liquid in the tray and/or would undesirably thaw frozen liquid in the tray again, is avoided thereby.

In particular, the evaporator is therefore thermally insulated from the interior space of the icemaker unit and also thermally insulated from the tray of the icemaker unit therefore.

It is preferably provided that, viewed in the height direction of the cooling device, the fan is arranged above the evaporator and, viewed in a plane perpendicular to the height direction, is arranged offset from the evaporator. This advantageous embodiment prevents increasing moisture from undesirably wetting this fan, in particular when the evaporator is defrosted. Undesirable frosting or ice formation on the fan is also prevented thereby. Freezing up of the fan wheel is prevented thereby.

In accordance with an advantageous embodiment the cooling device has a heating unit for defrosting the evaporator.

It can advantageously be provided that the fan is a radial fan. A radial fan is particularly powerful and therefore produces a particularly advantageous high pressure. Furthermore, they are also compact, so they can also be installed in the module of the cooling device so as to save space.

It is particularly advantageous if the household refrigerator is a no-frost household refrigerator having no-frost technology or a no-frost cooling technology device. In a no-frost household refrigerator this is cooled by means of a forced-air heat exchanger.

No-frost technology designates a technical method in which the humidity is reduced in an interior space designed as a freezer compartment. The comestibles consequently do not become frosted or this is significantly reduced and defrosting of the freezer compartment can be dispensed with or only has to be carried out at much reduced time intervals. With this kind of no-frost technology, cooling elements, designed for example as cooling fins, and therefore a heat exchanger of the secondary circuit are located in a separate region in the interior space. During the cooling phase, the cold air is then introduced from this separate region by way of a fan into the interior space and therefore the freezer compartment. These devices are designed in such a way that air circulates through all compartments of the interior space and enters the separate region again as a circuit. Since cold air contains less moisture, this primarily deposits itself as frost only on the heat exchanger of the secondary refrigeration circuit, which is located in the separate region, and is the coldest point in the no-frost household refrigerator which has contact with air. It can then be provided that a defrosting mode is implemented at specific intervals, in which mode this first heat exchanger is defrosted in the separate region. A heating device in particular is provided in a no-frost-household refrigerator for this purpose, by way of which this heat exchanger is heated. The water then produced from the defrosting layer of ice can run out of the interior space via a drainage channel, and therefore also out of the appliance and can be collected in a collecting tray which can also be used as an evaporation container. In particular, the fan is deactivated in the defrosting mode, so the freezer compartment continues to be kept cool. No-frost technology means icing up of cooling fins is significantly reduced and humidity is decreased throughout the household refrigerator, so the formation of layers of ice is also significantly reduced.

With an exemplary, relatively simple method, the humidity in the freezer compartment is significantly reduced with a no-frost appliance. This is achieved, in particular, by way of a separation of the cooling fins from the actual refrigeration area or refrigerator compartment, wherein the cold air is conveyed with the aid of a fan into the freezer interior space or the freezer compartment. The cold air circulates as a circuit through all compartments of the refrigerator and enters into the refrigerator zone again. Since it can absorb the moisture only poorly, and can retain it less well, the moisture deposits itself on the cooling fins. These are heated and defrosted at regular intervals and the water preferably passes, for example via a channel, into an evaporation container. The humidity throughout the appliance is reduced and almost no layers of ice form. In contrast to conventional appliances, the majority of the resulting moisture, which leads to freezing of the conventional upright freezer, accumulates in the separate region of the cooling fins in a household refrigerator having no-frost technology.

This principle of no-frost technology also applies to an embodiment of the cooling device of the icemaker unit as a no-frost cooling device.

The detail terms "above," "below," "in front," "behind," "horizontal," "vertical," "depth direction," "width direction," "height direction," etc. indicate the positions and orientations given in the case of an observer standing in front of the appliance and looking in the direction of the appliance in the case of conventional use and conventional arrangement of the appliance.

Further features of the invention emerge from the claims, figures and description of the figures. The features and combinations of features mentioned above in the description, as well as the features and combinations of features mentioned below in the description of the figures and/or shown only in the figures can be used not just in the respectively disclosed combination, but also in other combinations, without departing from the scope of the invention. Embodiments of the invention which are not explicitly shown and described in the figures, but emanate and can be produced from the described embodiments by separate combinations of features should therefore also be regarded as incorporated and disclosed. Embodiments and combinations of features should also be regarded as disclosed which do not exhibit all features of an originally worded independent claim therefore. Embodiments and combinations of features, in particular by way of the embodiments illustrated above, should also be regarded as disclosed, moreover, which go beyond the combinations of features illustrated in the appendancies of the claims or deviate therefrom.

Although the invention is illustrated and described herein as embodied in a household refrigerator with an icemaker unit and a cooling device having a pressure chamber for cooling the icemaker unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Identical elements or those with the same function are provided with the same reference numerals in the figures.

DETAILED DESCRIPTION OF THE INVENTION

Figure 1:
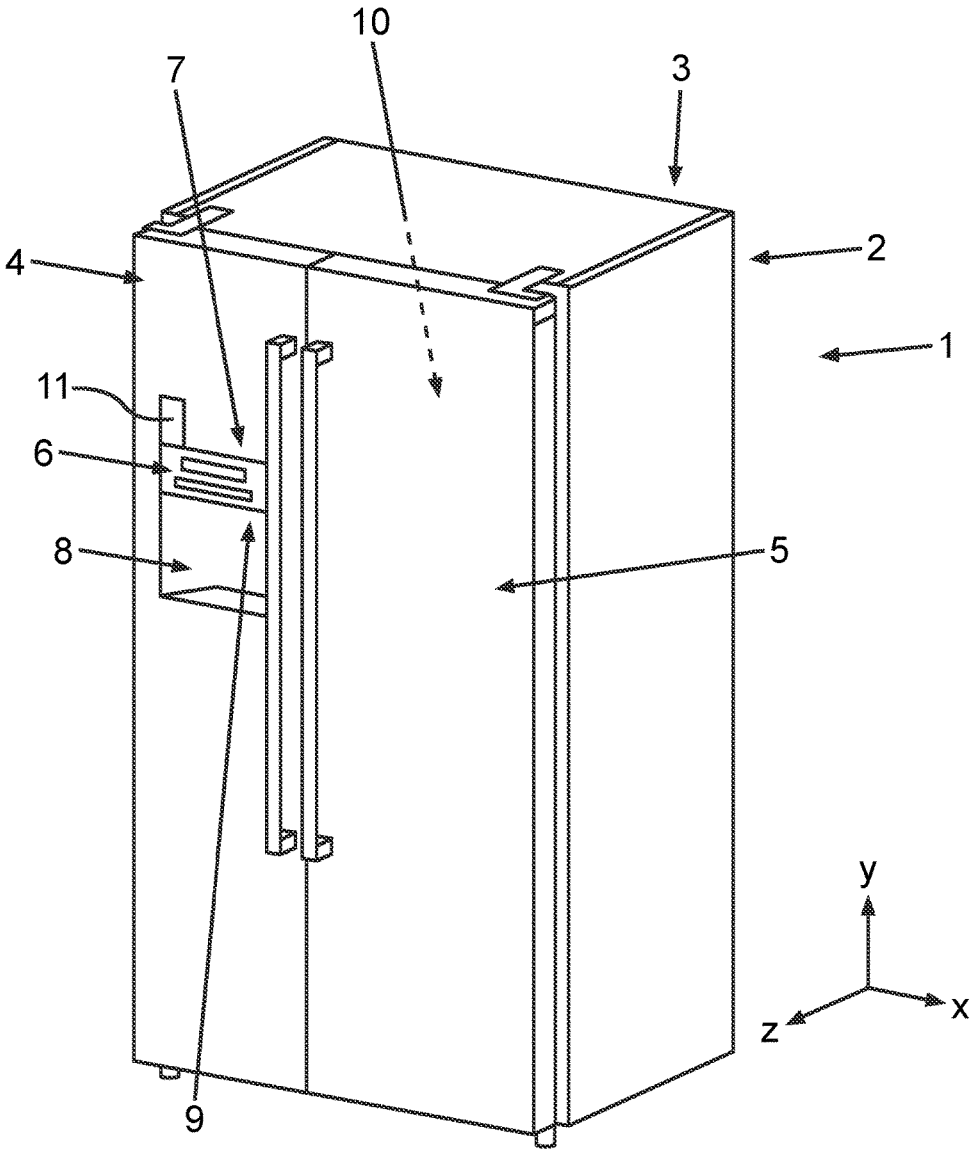
FIG. 1 is a perspective diagram of an exemplary embodiment of an inventive household refrigerator.

Referring now to the figures of the drawing in detail and first, particularly, to FIG. 1 thereof, there is shown a perspective diagram of a household refrigerator 1 which can be a refrigerator or an upright freezer. In the exemplary embodiment, the household refrigerator 1 is a side-by-side fridge-freezer. The household refrigerator 1 is designed for storing and preserving comestibles, such as food and drinks. The household refrigerator 1 comprises a housing 2, which delimits an interior space 10. This interior space 10 is designed to receive the comestibles. The housing 2 comprises a base body 3 and, in the exemplary embodiment, doors 4 and 5 pivotally arranged thereon. The doors 4 and 5 are designed to close the interior space 10. It can also be provided that there is a plurality of separate interior spaces instead of a single connected interior space 10. It can therefore be provided that a first interior space, which is separate from an interior space which can be closed by the other door 4, can be closed by the door 5.

Furthermore, the household refrigerator 1 comprises an icemaker unit 6 which is designed at least for dispensing free-flowing chilled goods, in particular ice cubes. What is known as slush ice can also be dispensed in addition to said dispensing of ice cubes. The icemaker unit 6 is arranged in the housing 2, wherein it can be arranged with at least sub-components in the interior space 10 and/or with sub-components at least in a wall of the base body 3 or a door 4 or can be arranged completely in such a wall and can therefore be arranged separately from the interior space 10.

The icemaker unit 6 is arranged for this purpose in a receiving space (not shown) which is formed in the housing 2. The receiving space can also be formed in the in the interior space 10 in this context. The receiving space for the icemaker unit 6 is designed solely to receive this icemaker unit 6.

The icemaker unit 6 comprises a control and display device 7 which is accessible and can be seen via a front side of the door 4. The user of the household refrigerator 1 can then introduce a collection vessel, such as, for example a glass, etc., into a recess 8 in the door for dispensing of the chilled goods, and the chilled goods can then pass into this vessel via an illustrated dispensing device 9 of the icemaker unit 6.

In addition to the dispensing device 9 already mentioned, the icemaker unit 6 preferably comprises a reservoir fluidically connected to the dispensing device 9, in which reservoir the liquid is contained. The dispensing device 9 extends partially into the recess 8 and can be operated by way of the control and display device 7. The household refrigerator 1 comprises a control unit 11 which should be understood to be merely exemplary and symbolically in respect of its embodiment and position.

Figure 2:
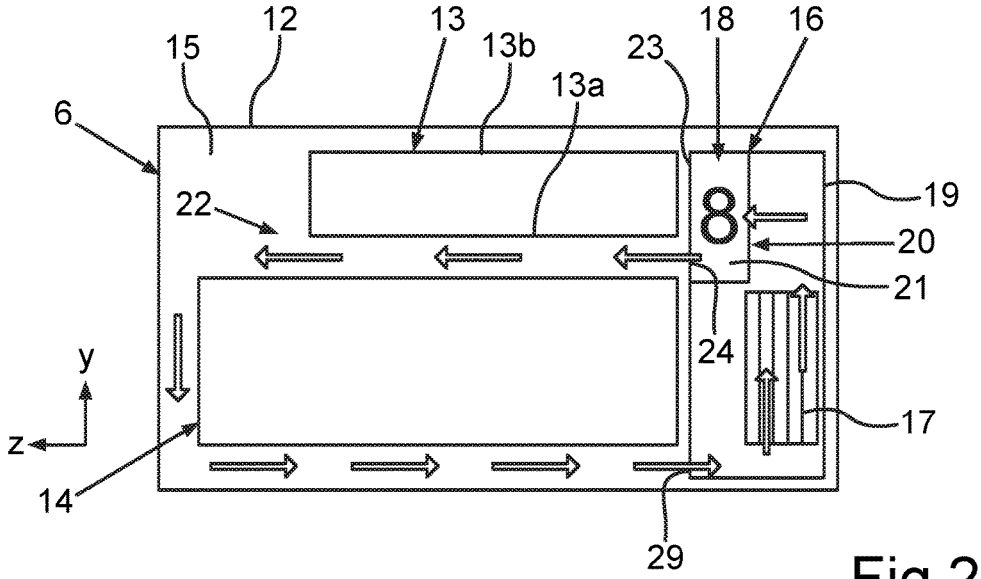
FIG. 2 shows a schematic diagram of an exemplary embodiment of an icemaker unit of the household refrigerator.
Figure 3:
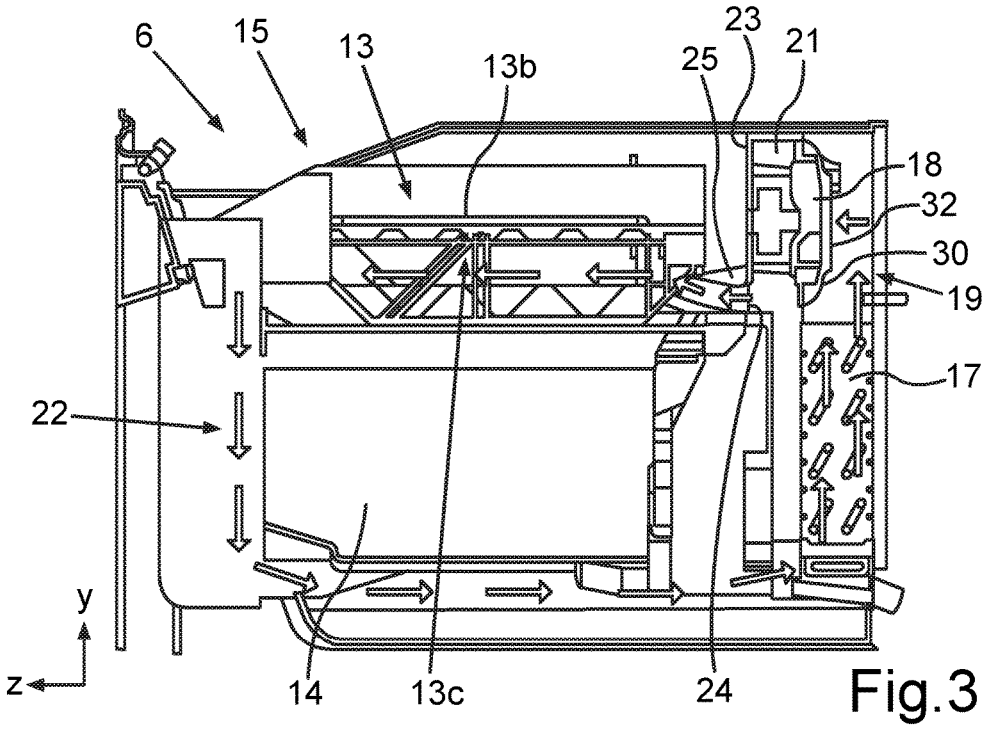
FIG. 3 shows a more detailed diagram of the embodiment of FIG. 2.

FIG. 2 shows the icemaker unit 6 in a schematic vertical sectional view. This comprises, in particular, a housing 12 in which, in particular, a tray 13 is arranged. The tray 13 comprises a shaping region 13*c* (FIG. 3). The shaping region 13*c* is designed for specifying the shape of shaped ice elements produced from liquid poured into the tray 13. In the exemplary embodiment the icemaker unit 6 comprises, moreover, a container 14 which is designed separately from the tray 13 and, viewed in particular in the vertical direction and therefore in the height direction (y-direction), is arranged under the tray 13 and spaced apart from this tray 13. Shaped ice elements, for example ice cubes, produced in the tray 13 can be collected in this container 14 when they are tipped out of the tray 13. Further dispensing up to the dispensing device 9 then takes place by way of this container 14.

The tray 13 and the container 14 are arranged in the interior 15 of the icemaker unit 6, in particular in the interior of the housing 12.

The icemaker unit 6 comprises, moreover, a cooling device 16 which in the illustrated embodiment is, in particular, a no-frost cooling device. The cooling device 16 is a separate unit and is therefore designed as a separate module. The cooling device 16 is arranged adjacent to the tray 13. It is positioned in the interior 15 of the housing 12.

In an advantageous embodiment the household refrigerator 1 can also be designed as a no-frost household refrigerator. The no-frost technology which then exists is designed with components independent of the cooling device 16, in particular also if the cooling device 16 is designed as a no-frost cooling device.

The cooling device 16 comprises an evaporator 17 and a fan 18. In particular, the evaporator 17 and the fan 18 are arranged in a housing 19 of the cooling device 16. As is schematically shown in FIG. 2, the fan 18 is arranged completely above the evaporator 17 in the height direction and in a plane perpendicular to this height direction, offset from the evaporator 17 at least in certain regions. This means that air rising from the evaporator 17 and also rising moisture do not then pass completely and extensively directly to the fan 18, but flow more or less upwardly past it.

The evaporator 17 is preferably a fin evaporator. The fan 18 is preferably a radial fan.

Preferably at least the evaporator 17 is arranged so as to be thermally insulated from the interior 15. In particular, a thermal insulation in relation to the tray 13 and the container 14 is therefore formed. It can in particular be provided that the walls of the, in particular, present housing 19 are thermally insulated.

It is particularly advantageously provided that the fan 18, in particular a fan wheel 27, is arranged in a separate pressure chamber 20, with this pressure chamber 20 delimiting, in particular by way of walls, a pressure volume or a pressure chamber volume 21. The fan 18 is therefore preferably arranged so as to be at least partially separate from the evaporator 17. As shown by the arrows in FIG. 2, the cooling air flow 22 symbolized thereby issues from the pressure chamber 20 and issues in a localized manner such that it flows only under a base 13*a* of the tray 13. The cooling air flow 22 does not flow along an upper side 13*b* of the tray 13.

The pressure chamber 20 comprises, in particular, a front chamber wall 23 which, viewed in the depth direction and therefore in the z-direction, is arranged between the fan 18 and the tray 13. This chamber wall 23 comprises an opening 24 from which the cooling air flow 22 can issue.

As shown in the slightly more detailed diagram of an embodiment of the icemaker unit 6 in FIG. 3, a flow channel stub 25, or flow conduit 25, is arranged so as to adjoin this opening 24. This flow conduit 25 extends from this chamber wall 23 in the direction of the tray 13. It can also be seen that, viewed in the height direction, the opening 24 is arranged under the fan 18 and above the evaporator 17. The flow conduit 25 is also positioned accordingly. The flow conduit 25 ends, in particular, under the tray 13.

Figure 4:
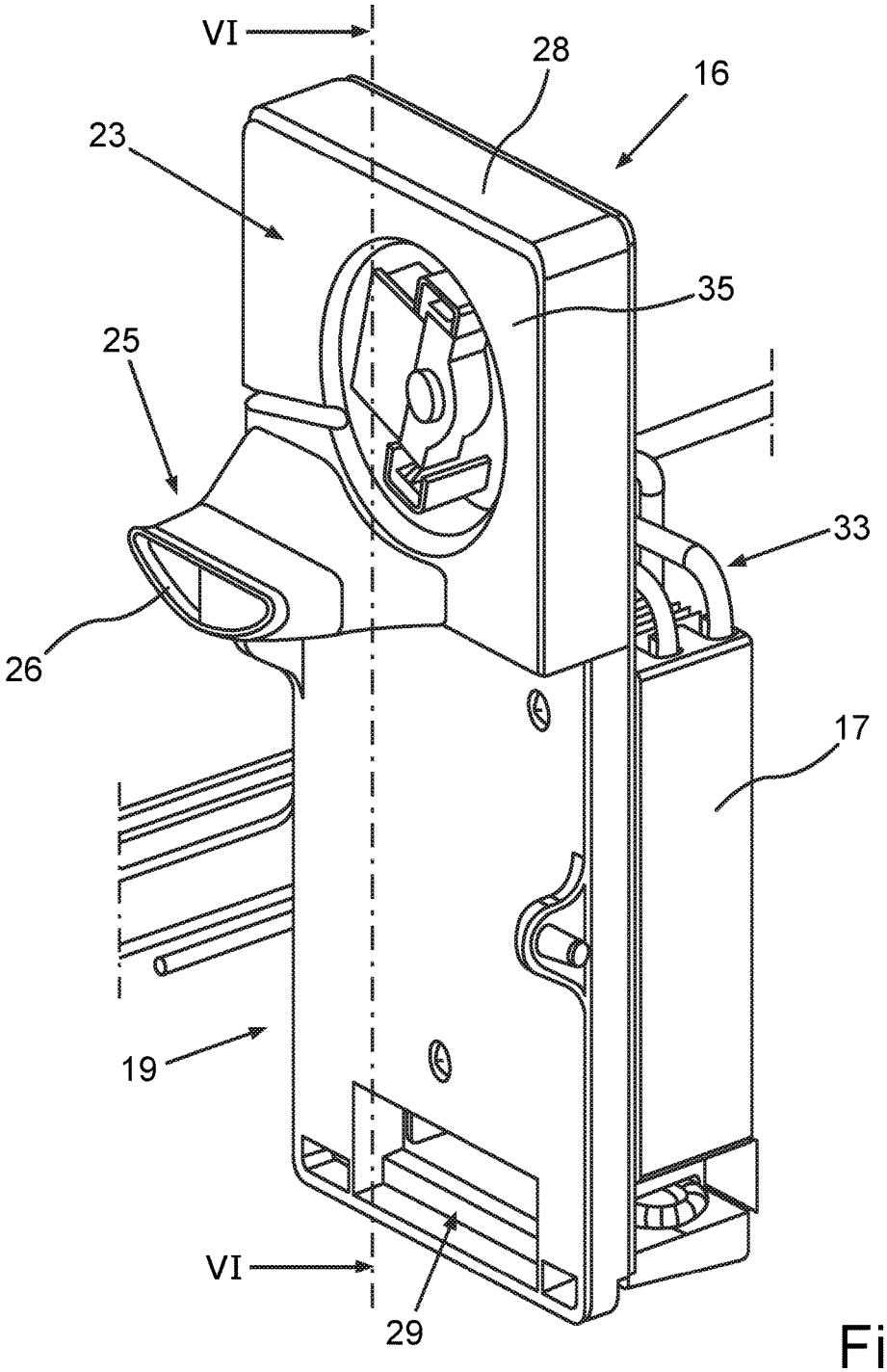
FIG. 4 is a perspective diagram of a cooling device of the icemaker unit in FIG. 2 and FIG. 3.

FIG. 4 shows the cooling device 16 in a perspective diagram, wherein here a preferably present housing 19 is illustrated with only one chamber wall 23 of the pressure chamber 20. The flow conduit 25 can be seen here, which tapers, in particular, from the opening 24 to a blow-out opening 26 of the flow conduit 25, in particular tapers in the manner of a funnel.

As can be seen here, a cross-section of this outlet opening or blow-out opening 26 is much smaller than the dimensions of the area of the chamber wall 23. In particular, this blow-out opening 26 is also much smaller in its cross-sectional area than a surface area of a fan wheel or fan wheel 27 of the fan 18 measured in this plane.

Furthermore, it can be seen that the chamber wall 23 has a cup-shaped region 28 which is arranged, in particular, centrally. The air is introduced into the cooling device 16 or sucked out of the interior 15 via an opening 29 of the housing 19 of the cooling device 16.

As can be seen, the fan wheel 27, which has blades 31 (FIG. 5), is completely covered by the chamber wall 23 in the direction of the tray 13 and egress of the cooling air flow 22 is enabled only via the blow-out opening 26.

Figure 5:
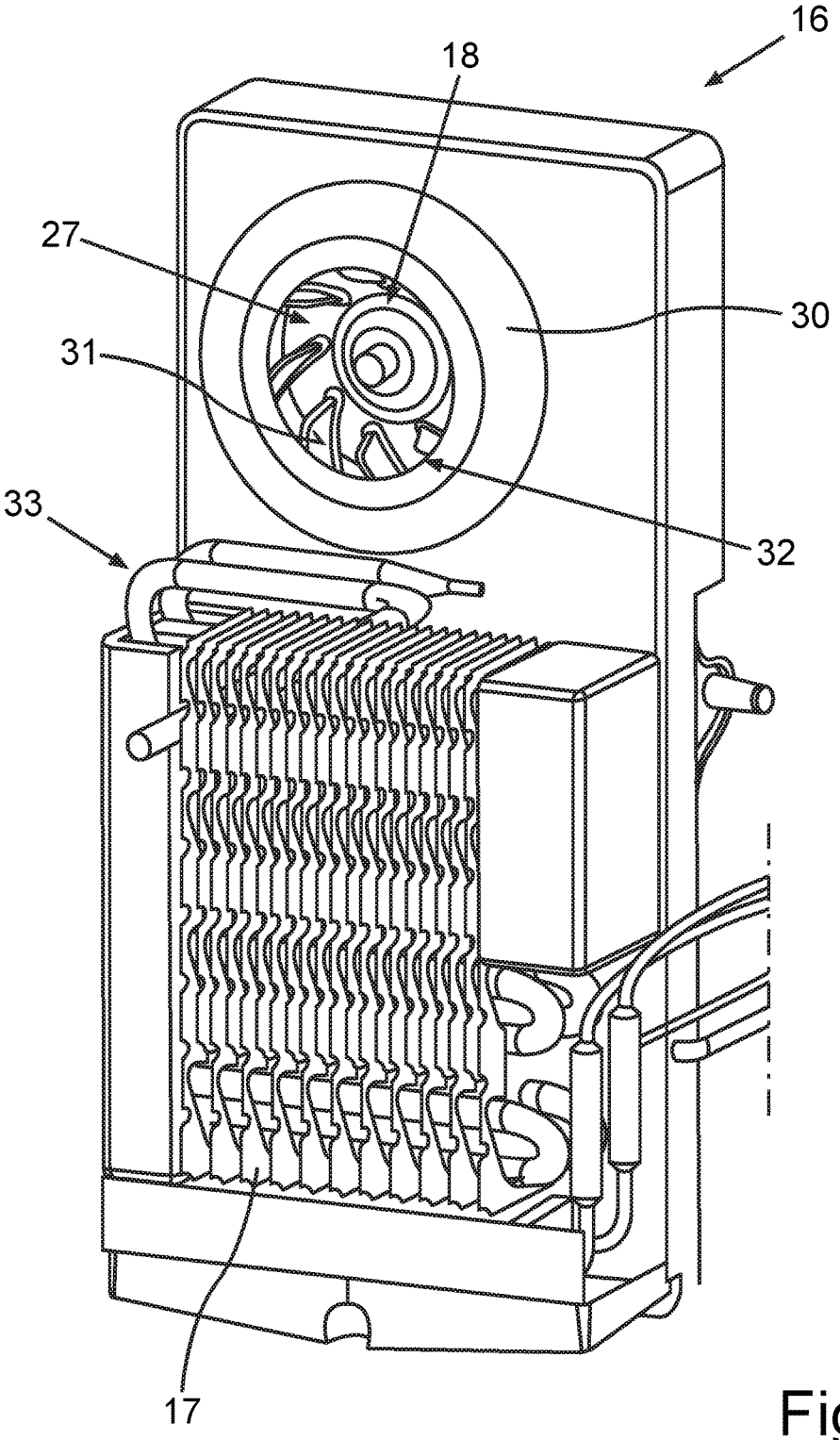
FIG. 5 is a diagram of the cooling device in an opposite perspective from FIG. 4.

FIG. 5 shows the cooling device 16 of FIG. 4 in a further perspective diagram, namely from behind. It can be seen that a further rear chamber wall 30 also delimits the pressure chamber volume 21. The air flowing through the evaporator 17 is then sucked into the pressure chamber 20 solely via a relatively small opening 32.

FIG. 4 and FIG. 5 also show, moreover, pipes of a heating unit 33, with which the evaporator 17 can be defrosted.

Figure 6:
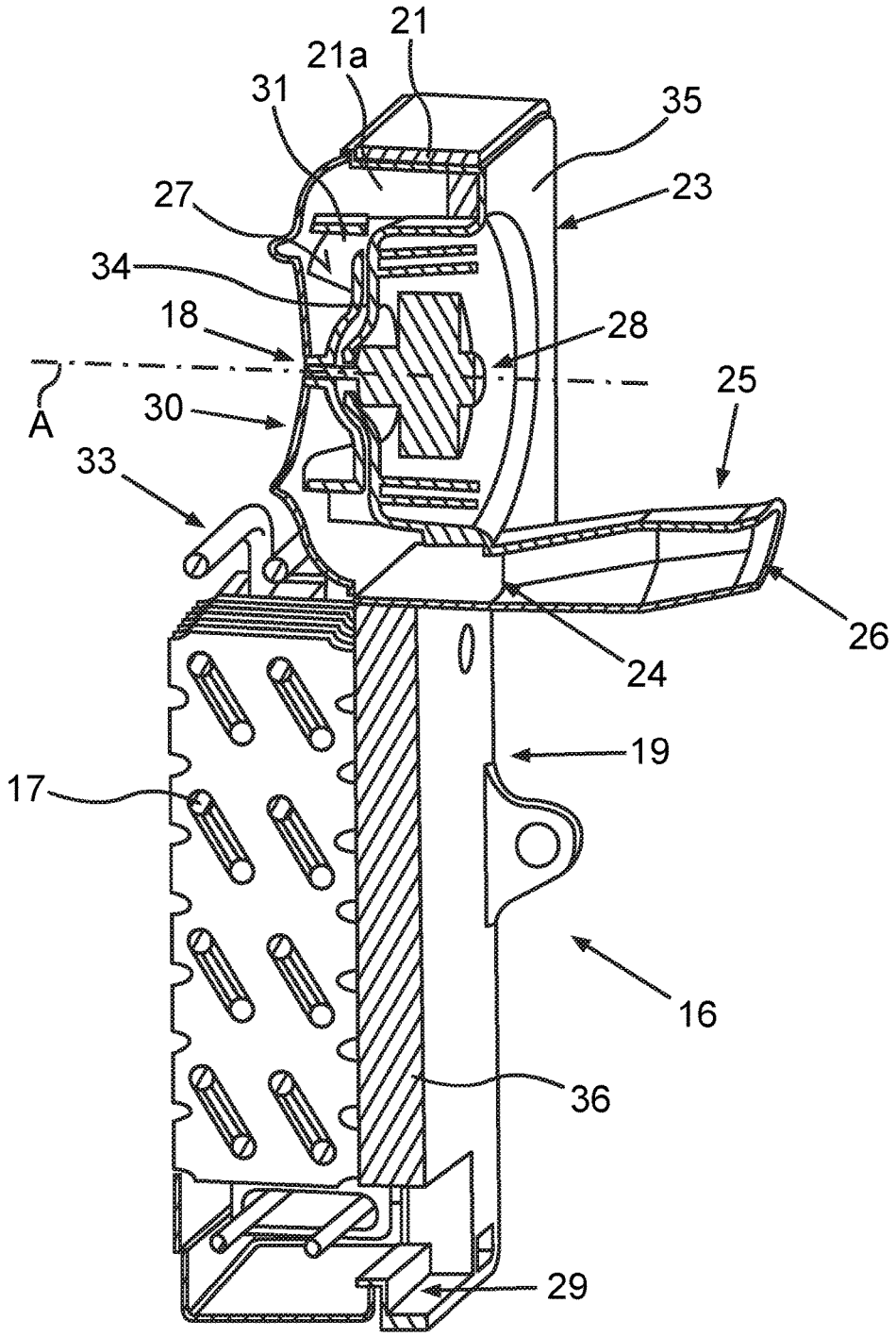
FIG. 6 is a perspective sectional view of the cooling device in FIG. 4 and FIG. 5.

FIG. 6 shows in a perspective sectional view along the cutting line VI-VI in FIG. 4, the cooling device 16. As can be seen here, the fan wheel 27 with its blades 31 is designed in the radial direction in relation to a longitudinal axis A of the cup-shaped region 28 with dimensions such that they extend essentially only over the relevant dimensions of the base 34 of this cup-shaped region 28. The pressure chamber volume region 21 is then designed to adjoin thereto in the radial direction, and is therefore designed in the circumferential direction around the axis A as a pressure chamber volume ring 21*a* or pressure volume ring. It therefore also extends in the radial direction so as to adjoin the fan wheel 27. Furthermore, this pressure chamber volume ring 21*a* extends further forward than the fan wheel 27 in the direction of the longitudinal axis A. This is also caused by the shaping of the chamber wall 23, in particular by the cup-shaped region 28. As can also be seen in FIG. 4 and FIG. 6, the front chamber wall 23 also has another wall region 35 adjoining this cup-shaped region 28 in the radial direction, which wall region therefore radially adjoins this cup-shaped region 28. As can also be seen in this regard in FIG. 4 and FIG. 6, the flow conduit 25 is formed on this wall region 35 and is therefore also positioned outside of the cup-shaped region 28 in the radial direction. In the axial direction it adjoins the pressure chamber volume ring 21*a* so as to directly axially follow. The opening 24 is formed in this wall region 35 in this context. In particular, it can be seen that in an advantageous embodiment the opening 24 is positioned further out in the radial direction in relation to the longitudinal axis A than the blades 31 of the fan wheel 27 extend. The fan wheel 27 is therefore completely covered, in particular at the front, by the chamber wall 23.

The embodiment of the cooling air device 16 in particular with the pressure chamber 20 and preferably the design of the front chamber wall 23, in particular with the position and embodiment of the flow conduit 25, produces very targeted conduction of the cooling air flow 22 to a specific position of the tray 13, namely only under a base 13*a*, and so as to graze along the base 13*a*. Furthermore, this embodiment also achieves a significantly increased air-volume flow of the cooling air flow 22. The targeted conduction of the cooling air flow 22 is improved even more in particular by the flow conduit 25 and the present air flow is produced with a lower loss of pressure, in particular due to reduced eddying.

FIG. 6 also shows a thermal insulating material 36 which is formed on the front wall of the housing 19 and which preferably extends at least over the height of the evaporator 17, so at least the evaporator 17 is thermally insulated in the housing 19 and is therefore also insulated from the interior space 15.

The pressure chamber volume ring 21*a* can be designed so as to be symmetrical in the azimuthal direction and therefore in the circumferential direction around the longitudinal axis A. It can, however, also be asymmetrical and at the region opposing the opening 24, viewed, for example, in the circumferential direction around the longitudinal axis A, can be designed with a shorter axial extension in the direction of the chamber wall 23 than in the region of the opening 24, as is shown in FIG. 6.

The following is a summary list of reference numerals and the corresponding structure used in the above description of the invention:

1 household refrigerator
2 housing
3 base body
4 door
5 door
6 icemaker unit
7 control and display device
8 recess

9 dispensing device
10 interior space
11 control unit
12 housing
13 tray
13*a* base
13*b* upper side
13*c* shaping region
14 container
15 interior space
16 cooling device
17 evaporator
18 fan
19 housing
20 pressure chamber
21 pressure chamber volume
21*a* pressure chamber volume ring
22 cooling air flow
23 chamber wall
24 opening
25 flow channel stub, flow conduit
26 blow-out opening
27 fan wheel
28 cup-shaped region
29 opening
30 chamber wall
31 blades
32 opening
33 heating unit
34 base
35 wall region
36 insulating material
A longitudinal axis

The invention claimed is:

1. A household refrigerator, comprising:

a housing formed with a receiving space;

an icemaker unit disposed in said receiving space for dispensing ice, said icemaker unit including a tray formed with shaping regions for specifying a shape of shaped ice elements to be produced from liquid poured into said tray and a cooling device for producing a cooling air flow for cooling said tray;

said cooling device including an evaporator and a fan with a fan wheel configured to generate the cooling air flow with cold produced by said evaporator; and said cooling device including a separate pressure chamber housing said fan wheel, said pressure chamber having a chamber wall disposed between said fan and said tray and formed with an opening through which the cooling air flow is conducted towards said tray; and wherein said tray has a base and said opening is configured to purposefully conduct the cooling air flow only under said base of said tray.

2. The household refrigerator according to claim 1, wherein, viewed in a height direction of said icemaker unit, said opening is arranged below said tray and above said evaporator.

3. The household refrigerator according to claim 1, which comprises a flow conduit protruding at said opening from said chamber wall in a direction of said tray.

4. The household refrigerator according to claim 3, wherein said flow conduit is beak-shaped.

5. The household refrigerator according to claim 3, wherein said flow conduit terminates under a base of said tray.

6. The household refrigerator according to claim 1, wherein said chamber wall has a cup-shaped region, to form a pressure chamber volume delimited by chamber walls of said pressure chamber with a pressure chamber volume region radially adjoining a longitudinal axis of said cup-shaped region at said cup-shaped region and which is formed as a pressure chamber volume ring.

7. The household refrigerator according to claim 6, wherein, viewed in a direction of a longitudinal axis of said cup-shaped region, said fan wheel is arranged adjacent to a base of said cup-shaped region.

8. The household refrigerator according to claim 7, wherein a radial dimension of said fan wheel is less than or equal to a radial dimension of the base of said cup-shaped region.

9. The household refrigerator according to claim 6, wherein, viewed in a radial direction to a longitudinal axis, said flow conduit is formed at a wall region of said chamber wall that outwardly follows a cup-shaped region of said flow conduit in the radial direction.

10. The household refrigerator according to claim 6, wherein said flow conduit is an axial extension of said pressure chamber volume ring.

11. The household refrigerator according to claim 3, wherein, viewed in a radial direction to a longitudinal axis, said flow conduit is formed at a wall region of said chamber wall that outwardly follows a cup-shaped region of said flow conduit in the radial direction.

12. The household refrigerator according to claim 1, wherein said evaporator is arranged in a housing of said cooling device and said housing is provided, at least in certain regions thereof, with a thermal insulating material.

13. A household refrigerator, comprising:

a housing formed with a receiving space;

an icemaker unit disposed in said receiving space for dispensing ice, said icemaker unit including a tray formed with shaping regions for specifying a shape of shaped ice elements to be produced from liquid poured into said tray and a cooling device for producing a cooling air flow for cooling said tray;

said cooling device including an evaporator and a fan with a fan wheel configured to generate the cooling air flow with cold produced by said evaporator; and said cooling device including a separate pressure chamber housing said fan wheel, wherein, viewed in a height direction of said cooling device, said fan is arranged above said evaporator and, viewed in a plane perpendicular to the height direction, said fan is arranged offset from said evaporator.

14. The household refrigerator according to claim 1, wherein said cooling device comprises a heating unit for defrosting said evaporator.

15. The household refrigerator according to claim 1, wherein said fan is a radial fan.

16. A household refrigerator, comprising:

a housing formed with a receiving space;

an icemaker unit disposed in said receiving space for dispensing ice, said icemaker unit including a tray formed with shaping regions for specifying a shape of shaped ice elements to be produced from liquid poured into said tray and a cooling device for producing a cooling air flow for cooling said tray;

said cooling device including an evaporator and a fan with a fan wheel configured to generate the cooling air flow with cold produced by said evaporator; and said cooling device including a separate pressure chamber housing said fan wheel, said pressure chamber having a chamber wall disposed between said fan and said tray and formed with an opening through which the cooling air flow is conducted towards said tray; and said chamber wall having a cup-shaped region, to form a pressure chamber volume delimited by chamber walls of said pressure chamber with a pressure chamber volume region radially adjoining a longitudinal axis of said cup-shaped region at said cup-shaped region and which is formed as a pressure chamber volume ring.

17. The household refrigerator according to claim 16, wherein, viewed in a direction of a longitudinal axis of said cup-shaped region, said fan wheel is arranged adjacent to a base of said cup-shaped region.

18. The household refrigerator according to claim 17, wherein a radial dimension of said fan wheel is less than or equal to a radial dimension of the base of said cup-shaped region.

19. The household refrigerator according to claim 16, wherein, viewed in a radial direction to a longitudinal axis, said flow conduit is formed at a wall region of said chamber wall that outwardly follows a cup-shaped region of said flow conduit in the radial direction.

20. The household refrigerator according to claim 16, wherein said flow conduit is an axial extension of said pressure chamber volume ring.

* * * * *